US006186046B1

(12) United States Patent
Allart et al.

(10) Patent No.: US 6,186,046 B1
(45) Date of Patent: Feb. 13, 2001

(54) HYDRAULIC MOTOR

(75) Inventors: Bernard Allart, Crepy-en-Valois; Louis Bigo, Compiegne; Marc Perot, Eve, all of (FR)

(73) Assignee: Poclain Hydraulics, Verberie (FR)

( * ) Notice: Under 35 U.S.C. 154(b), the term of this patent shall be extended for 0 days.

(21) Appl. No.: 09/099,996

(22) Filed: Jun. 19, 1998

(30) Foreign Application Priority Data

Jun. 23, 1997 (FR) ..... 97 07766

(51) Int. Cl.[7] ..... F01B 1/06
(52) U.S. Cl. ..... 91/491; 417/273
(58) Field of Search ..... 91/491; 92/72; 417/273

(56) References Cited

U.S. PATENT DOCUMENTS 4,404,896 * 9/1983 Allart et al. ..... 91/491
4,704,948 * 11/1987 Wusthof et al. ..... 92/72
5,186,094 * 2/1993 Allart et al. ..... 91/491
5,261,318 11/1993 Allart ..... 91/491
5,632,191 * 5/1997 Lemaire et al. ..... 91/491

FOREIGN PATENT DOCUMENTS 2533965 12/1986 (FR) .

* cited by examiner

*Primary Examiner*—Charles G. Freay
(74) *Attorney, Agent, or Firm*—Ladas & Parry

(57) ABSTRACT

A hydraulic motor comprises a fixed case, a reaction member secured to the case, a cylinder block mounted to rotate relative thereto about an axis of rotation, and an internal fluid distributor prevented from rotating about the axis relative to the case. The case has a "distribution cover" portion situated around the have respective first and second housings are formed to received a pin which prevents relative rotation while allowing the distribution cover in an axial direction, thereby preventing the distributor from separating from the cover while the motor is being assembled.

9 Claims, 2 Drawing Sheets

HYDRAULIC MOTOR

FIELD OF THE INVENTION

The present invention relates to a hydraulic motor comprising:

a fixed case;

a reaction member secured to the case;

a cylinder block mounted to rotate relative to said reaction member about an axis of rotation and comprising a plurality of cylinder and piston assemblies disposed radially relative to the axis of rotation and capable of being fed with fluid under pressure, the cylinder block having a communication face perpendicular to the axis of rotation; and an internal fluid distributor secured to the case to prevent rotation about the axis of rotation and having a distribution face perpendicular to the axis of rotation and suitable for being pressed against the communication face of the cylinder block, and a first connection face, said distributor including distribution ducts which extend between the first connection face and the distribution face;

the case having a "distribution cover" portion situated around the distributor and presenting a second connection face situated facing the first connection face and having feed and exhaust ducts opening out therein, the distribution ducts of the distributor thus being suitable for putting the cylinders into communication with the main fluid feed and exhaust ducts.

BACKGROUND OF THE INVENTION

In that type of motor, the distributor and the distribution cover belong to the stator and are generally secured to each other and constrained to rotate one with the other so as to obtain a relative angular position that is very accurate between the distributor and the reaction member which is itself secured to rotate with the distribution cover. To secure the parts in this way and obtain such accurate positioning, various systems have been proposed. Thus, the distributor has been provided with a radial flange extending between the cylinder block and the distribution cover, and an axial peg has been provided to secure the flange to the distribution cover. Other systems using tenons and notches have also been provided.

Although those various solutions do indeed make it possible to ensure positioning in rotation, at least those which use the radial flange suffer from the major drawback of requiring special machining of the distributor and of thereby increasing manufacturing costs. In addition, the presence of the flange increases the axial length of the motor.

Furthermore, it is necessary to take very great care in assembling the motor. In particular the distributor must be accurately positioned in the distribution cover and the regions of the first and second connection faces respectively connected to the feed duct and to the exhaust duct must naturally be completely isolated form each other, which means that sealing gaskets must be provided between the first and second connection faces, and said gaskets must be accurately positioned.

When assembly is complete, it is necessary to make provision for a small amount of axial movement between the distributor and the distribution cover, thus enabling the distribution face to bear against the communication face of the cylinder block.

OBJECT AND SUMMARY OF THE INVENTION

The present invention seeks to provide a simplified system making it possible to ensure accurate constraint in rotation of the distributor and of the distribution cover while also facilitating assembly of the motor, i.e., in particular, simplifying assembly of the subassembly constituted by the distributor and the distribution cover relative to the cylinder block, while holding the distributor axially in the distribution cover and simultaneously making axial movement of the distributor possible as is required in operation, but doing so to an extent that is only just sufficient, so as to guarantee that the sealing gaskets stay in their housings without any risk of being damaged.

This object is achieved by the fact that the distribution cover and the distributor are provided respectively with first and second axial parts in which there are formed at least a first substantially radial housing and at least a second substantially radial housing defining at least a first pair of housings situated facing each other, by the fact that the first housing has a first wall element situated on the side of said housing that is axially adjacent to the cylinder block while the second housing has a second wall element situated on the side of said second housing that is axially remote from the cylinder block by the fact that it includes a locking pin for preventing rotation disposed in said first and second housings so as to extend substantially radially, by the fact that one of the first and second housings has axial dimensions measured along the axis of rotation of the motor that are greater than the corresponding dimensions of the pin to enable the distributor to move relative to the distribution cover, and by the fact that one of the first and second housings is a substantially radial through passage via which the pin can be put into place.

It will be understood that by very simple machining consisting in providing the first and second housing respectively in the axial portion of the distribution cover and in the axial portion of the distributor and by using a single pin, the distributor is prevented form rotating relative to the distribution cover, In addition, the pin also provides axial locking since when maximum axial clearance is obtained between the distributor and the distribution cover, the pin co-operates in abutment with the first and second wall elements to prevent the distributor from moving relative to the distribution cover in the axial direction tending to bring the distributor closer to the cylinder block, thereby greatly simplifying assembly.

To assemble the motor, after the shaft has been assembled together with its bearings, a case portion, and distributor and the distribution cover together using the pin so as to make up a "distribution subassembly", and then to bring the subassembly up to the cylinder block.

While the distributor is being brought up in this way, with its distribution face facing generally downwards, the distributor is prevented form rotating and is held axially inside the distribution cover by the pin which is in abutment simultaneously against both the first and the second wall elements, so it suffices to hold the distribution cover in order to control installation of the distribution subassembly on the cylinder block until the distribution and communication faces come into contact.

In an advantageous embodiment, the first and second axial parts are formed respectively in an internal axial extension of the distribution cover which has the first housing passing therethrough and in an axial part of the distributor having an axially outer periphery in which the second housing forms a recess, and the motor includes means for enabling the locking pin to be inserted in said first and second housings from the radially outer side of said internal axial extension.

In this embodiment, it is thus the first housing which constitutes a through passage, while the second housing is merely a recess. The pin is installed form the radially outer side of the extension of the distribution cover, which side is often the most easily accessible.

BRIEF DESCRIPTION OF THE DRAWINGS

The invention will be well understood and its advantages will appear more clearly on reading the following detailed description of an embodiment given by way of non-limiting example. The description refers to the accompanying drawings, in which.

MORE DETAILED DESCRIPTION

Figure 1:
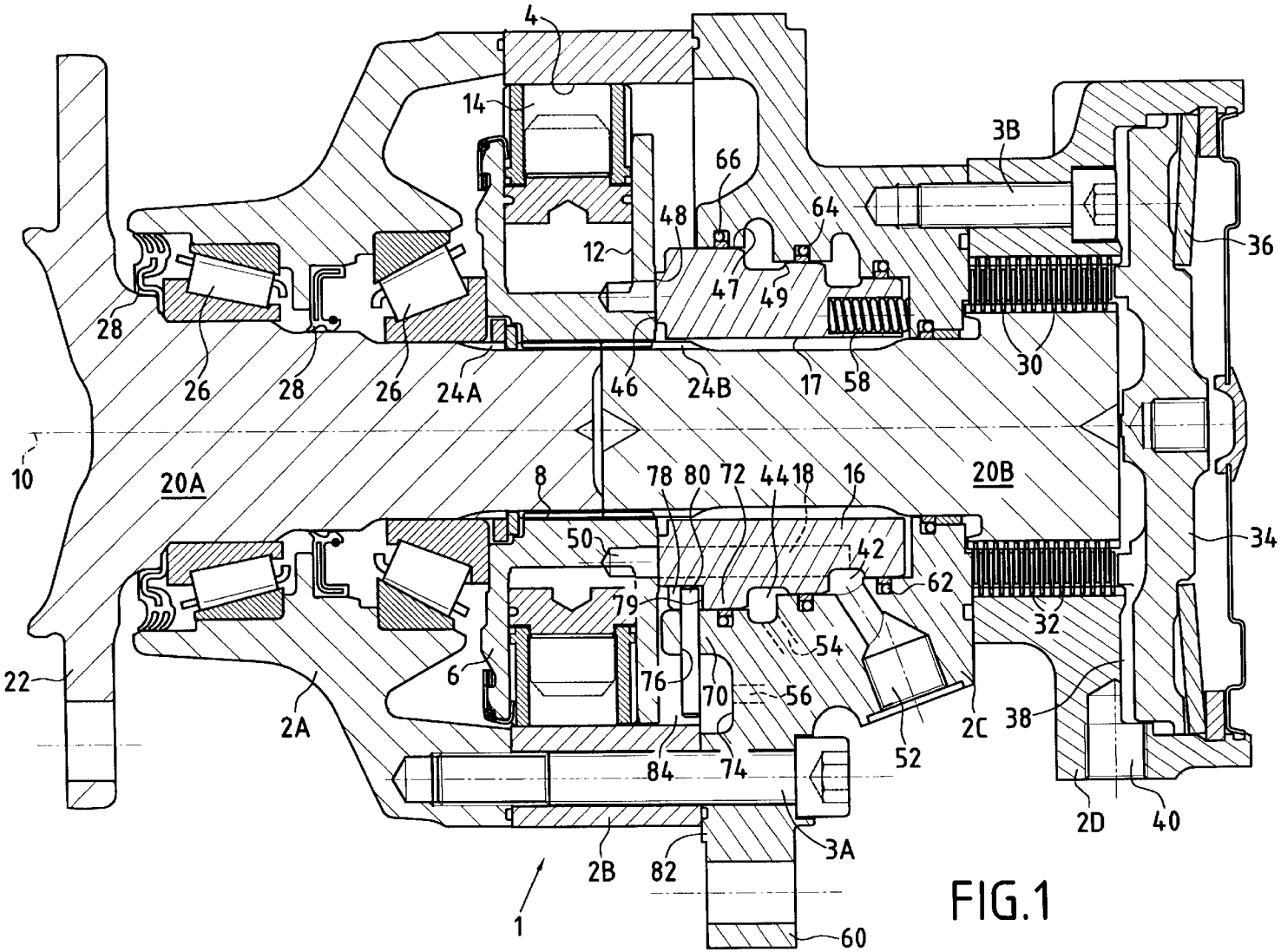
FIG. 1 is an axial section view of a motor in accordance with the invention.

The hydraulic motor 1 shown in FIG. 1 comprises:

a fixed case comprising four portions 2A, 2B, 2C, and 2D, the portions 2A, 2B, and 2C being assembled together by screws 3A, while the portions 2C and 2D are assembled together by screws 3B;

an undulating reaction cam 4 formed on the inside periphery of portion 2B of the case;

a cylinder block 6 having a central bore 8 and mounted to rotate relative to the undulating reaction cam 4 about an axis of rotation 10, the cylinder block having a plurality of radial cylinders 12 suitable for being fed with fluid under pressure, and having pistons 14 slidably mounted therein;

an internal fluid distributor 16 secured to the case against rotation about the axis 10 (i.e., like the 10), and including distribution ducts 18 suitable for communicating with the cylinders 12;

a shaft in tow portions, a first portion 20A being disposed inside case portions 2A and 2B and having one end situated outside the case (projecting beyond case portions 2A) where it has a coupling flange 22 for coupling to the object that is to be rotated by the motor, and a second portion 20B extending along an axial bore 17 of the distributor form case portion 2B to case portion 2D; and a brake device disposed in said portion 2D.

The drive shaft 20 A and the brake shaft 20B are constrained to rotate with the cylinder block by co-operation operation between axial fluting 24A and 24B respectively on the peripheries of the shafts, and complementary axial fluting presented by the bore 8 of the cylinder block. The drive shaft 20A is supported in rotary manner in case portion 2A by roller bearings 26. The space inside case portion 2A is sealed relative to the shaft 20A by gaskets 28.

The brake device placed inside case portion 2D comprises a fist series of brake disks 30 secured to rotate with the shaft 20B and a second series of brake disks secured to rotate with the brake casing portion 2D. The disks in the series 30 and 32 are interposed between one another. A brake piston 34 is biased by a spring washer 36 to urge the disks in the series 30 and 32 into rubbing contact so as to perform braking. A brake release chamber 38 suitable for being fed with fluid via a duct 40 is situated on the side of the brake piston 34 that faces towards the cylinder block. The effect of putting this chamber under pressure opposes that of the spring washer 36, thus releasing the braking.

Grooves 42 and 44 are formed between the inner periphery of case portion 2C which constitutes the second connection face 49 and the outer periphery of the distributor 16 which constitutes the first connection face 47. Both of these grooves have respective distribution ducts, such as the duct 18 shown in dashed lines, connecting them to the distribution face 46 of the distributor which is pressed against the communication face 48 of the cylinder block. In this way, the distribution ducts (18) are capable of being connected in alternation to the cylinder ducts (50) to feed the cylinders with fluid under pressure or to enable fluid to escape form the cylinders. The grooves 42 and 44 are themselves connected to the main feed duct and to the main exhaust duct formed in case portion 2C and known as the "distribution cover". Thus, a main feed or exhaust duct 52 is shown connected to the groove 42, while the other main duct 54 (not situated in the section plane) connected to the groove 44 is merely represented by dashed lines.

The grooves 42 and 44 are staged relative to each other. They are isolated by sealing rings providing sealed contact between axial parts of the connection faces 47 and 49. In this way, a first sealing ring 62 is situated on the side of the groove 42 that is remote from the cylinder block, a second sealing ring 64 is situated between the grooves 42 and 44, and a third sealing ring 66 is situated on the side of the groove 44 that is close to the cylinder block. Naturally, to ensure that sealing contact is indeed provided, it is necessary not only for the sealing rings to be of the proper dimensions, but also to take care that they are properly situated in the axial portions of the connection faces that they are to seal.

It should be observed that the motor shown in FIG. 1 has only one operating cylinder capacity. The invention is also applicable to a motor having two cylinder capacities, in which case it is possible to provide a third groove which is staged relative to the grooves 42 and 44, and also a cylinder capacity selection slide valve suitable for putting the grooves selectively into communication and, for example, under hydraulic control via an auxiliary fluid circuit.

Thus the distribution cover may include ducts other than the main feed and exhaust ducts, for example the duct for controlling the cylinder capacity selection slide valve or other ducts serving to perform auxiliary functions regardless of whether the motor has one or tow operating cylinder capacities. In addition, the cover includes a leakage return duct for removing fluid leaks that may occur inside the case, in particular between the distribution and communication faces 46 and 48. In FIG. 1, a leakage return duct 56 is merely represented by dashed lines.

The distribution face 46 is held pressed against the communication face 48 by one or more mechanical springs 58. Instead of such mechanical thrust, provision could be made for hydraulic thrust.

The motor shown is a motor having a rotary shaft and a stationary case. By way of example, the case may be fixed to the chassis of a vehicle by means of a flange 60 constituting a radial extension from the distribution cover 2C.

The distribution cover 2C has a first axial part 70 extending facing a second axial part 72 belonging to the distributor 16. These two axial parts extend inside the case, the first axial part 70 being constituted, for example, by an internal axial extension of the distribution cover 2C extending towards the cylinder block from a substantially radial face 74 of the distribution cover, itself situated at a distance from the cylinder block.

The second axial part 72 belonging to the distributor 16 is formed inside the extension 70 and extends over a region of the distributor situated between the sealing ring 66 which isolates the groove 44 nearest to the cylinder block on its side facing towards the cylinder block form the distribution face 42 of the distributor. A first housing 76 is formed in the first axial part 70 and a second housing 78 is formed in the second axial part 72. The housings 76 and 78 face each other when the distributor 16 is put into place inside the distribution cover 2C, and they extend substantially radially, i.e., both of them are of dimensions enabling them to receive a pin 80 extending substantially radially.

As can be seen in FIG. 1, the first housing 76 has a wall element situated on the side of this first housing that is axially adjacent to the cylinder block. In the example shown, this wall element is not referenced since the housing 76 is constituted merely by a hold drilled through the extension 70, which is itself in the form of an axial finger. The housing 76 is thus cylindrical and has a continuous wall around its entire periphery.

The second housing 78 has a wall element 79 situated on its side that is axially remote from the cylinder block 6. The locking pin 80 is disposed in the first and second housings, thereby locking the distributor 16 relative to the distribution cover 2C against rotation about the axis 10 while holding the distributor 16 axially in the distribution cover 2C.

As mentioned above, the distribution face 46 of the distributor 16 must press against the communication face 48 of the cylinder block. For this purpose, it is necessary for the distributor to be provided with the ability to move axially, even when the pin 80 is in place in the housings 76 and 78. To this end, one of the housings is of dimensions in the axial direction of the motor greater than the diameter of the pin (which diameter is measured along the axis 10 given that the pin is disposed substantially radially). In the example shown, the housing 76 is a cylindrical hold of diameter analogous to that of the pin and it is the housing 78 whose size in the axial direction of the motor is greater than the diameter of the pin, thereby ensuring the necessary freedom to move in the axial direction. It should be observed that to make this small amount of axial movement possible while providing axial retention that facilitates assembly, the housing 78 is dimensioned so that the distribution face 46 comes to press against the communication face 48 before the pin comes into axial abutment contact against the wall element 79.

Figure 2:
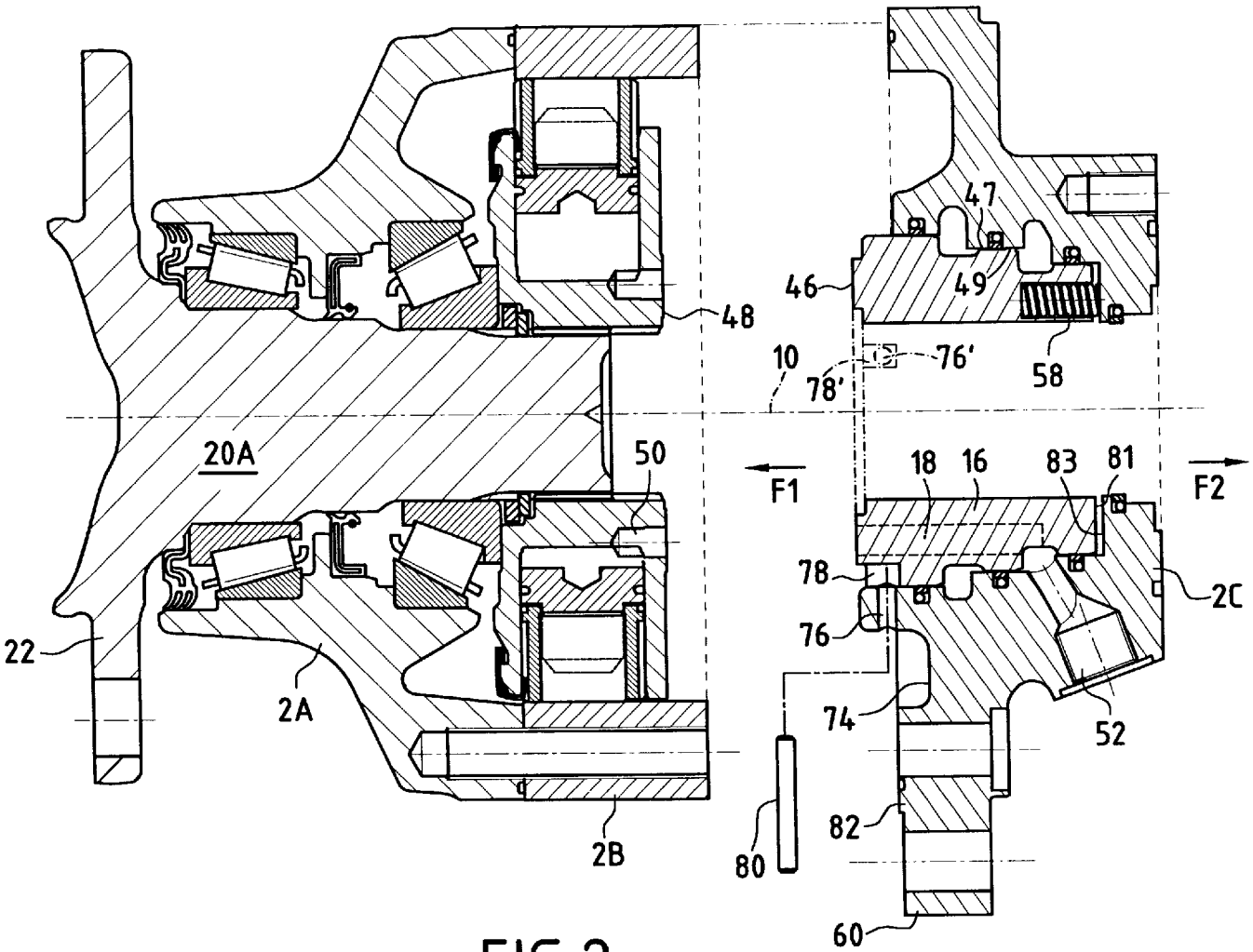
FIG. 2 is an axial section view of certain elements of the same motor during assembly.

As can be seen more clearly in FIG. 2, when assembling the distributor and the distribution cover, the distributor 16 is place inside the cover 2C and the pin 80 is inserted in the hole 76 from the radially outer side of the extension 70 and the pin is engaged until its end closest to the axis 10 has been inserted in the housing 78.

In the example shown, the second housing 78 constitutes merely a recess in the axially outer peripheral portion of the distributor 16 which forms the second axial part 72. This recess is open to the outer radial periphery and to the axial end of the distributor 16 that is closest to the cylinder block. In contrast, it is closed by the wall element 79 on its side remote form the cylinder block.

As can be seen more clearly in FIG. 2, it is possible to insert the pin 80 via that radially outer side of the extension 70 because the finger constituting this extension 70 extends axially beyond the axial face 82 of the outer flange 60 of the distribution cover 2C. In this way, the hold 76 is made in a portion of the finger 70 which projects axially relative to the parts of the distribution cover 2C that are situated radially outside the finger 70. Insertion of the pin is further facilitated by the fact that the radial face 74 is set back relative to the axial end 82. This provides a clearance zone 84 on the radially outer side of the finger 70.

In addition, when the case is assembled, the finger 70 extends not only inside the portion 2C of the case, but also inside the portion 2B of the case, i.e. inside an element of the case which is different from the distribution cover and which is assembled thereto. Thus, as can be seen in FIG. 2, it is extremely easy to put the pin into place before assembling together the portions 2B and 2C of the case.

In a variant, the second housing 78 could be implemented in the form of a hole passing through the axial portion 72 of the distributor in a region where there is no distribution duct, thereby making it possible to insert the pin via the radially inner side before installing the shaft 20B. Under such circumstances, it would be the first housing 76 that is provided with dimensions in the axial direction of the motor that are greater than the diameter of the pin so as to allow the distributor to move axially relative to the cover 2C.

In the example shown, the first housing 76 is constituted by a hold of dimensions suitable for receiving the pin 80 with substantially no play, while the second housing is constituted by a simple notch formed from the axial end of the distributor that is closer to the cylinder block 6.

Advantageously, as in the example shown, the first and second axial portions are formed respectively in zones of the distribution cover 2C and of the distributor 16 which are close to the cylinder block. These zones are generally more accessible for insertion of the pin once the distributor 16 has been placed inside the distribution cover 2C.

To hold the pin 80 in place in the holes 76 and 78, the pin is preferably a force-fit in the housing 76. For this purpose, the pin 80 has an outer periphery which, for the most part, has a radius that is no greater than that of the hole, but which is provided with fluting giving it locally a radius which is greater than that of the hold 76. When the pin is inserted into the hole, the fluting is crushed so as to match the radius of the hole and the pin is thus held by force. Another solution would consist in using a pin of a length such that once it has been inserted substantially without clearance in the hole 76 and received in the recess 78, its free and projecting from the hole 76 is close to the inside face of the case 2B so as to be retained along its own axis thereby.

As can be seen more clearly in FIG. 2, when assembling the motor, a subassembly is made comprising the shaft 20A, the bearings 26, the gaskets 28, and case portion 2A, preferably by placing the shaft 20A vertically with its flange 22 at the bottom. Thereafter case portion 2B carrying the cam 4 is put into place on case portion 2A before engaging the cylinder block 6 inside the cam and causing the fluting 8 of the cylinder block to co-operate with the fluting 24A of the shaft 20A. Separately, the springs 58, the sealing rings 62, 64, and 66, which have been placed in the axial portions inside the distribution cover 2C and the pin 80 is put into place in the manner described above, This prevents the distributor form rotating and holds it axially inside the distribution cover since extracting it in the direction of arrow F1 is prevented by the pin, while extracting it in the direction of arrow F2 is prevented by co-operation between the radial end 81 of the distributor and the shoulder 83 of the distribution cover. In any event, movement of the distributor in the direction of arrow F2 relative to the cover 2C is prevented by the fact that the connection faces are staged, with the diameters of their respective axial portions decreasing in the direction of arrow F2.

To connect together case portions 2C and 2B, the distribution subassembly constituted by the distributor 16 and the distribution cover 2C is brought up to the portion 2B. This is often done downwards, i.e, with the distribution face 46 facing downwards. While these subassemblies are being moved towards each other, the distributor 16 is held axially relative to the cover 2C, with the only axial movement possible being that required subsequently to enable the distribution face to press against the communication face. The sealing rings 63, 64, and 66 which have been placed in the axial portions designed to receive them cannot be moved out of their housings and are not in danger of being damaged during assembly. By means of these dispositions, it is possible to dimension the axial portions of the connection faces that are to receive the sealing rings much more accurately than in the prior art since it is guaranteed that there will be no significant axial displacement of the distributor 16 relative to the cover 2C once the pin has been put into place. This makes it possible to limit the axial dimensions of the cover 2C and of the distributor 16 and consequently to reduce the axial size of the motor. In this respect, it should be observed that the axial portions 70 and 72 do not give rise to any increase in axial length compared with prior art motors. The invention thus makes it possible simultaneously to prevent the distributor form rotating, to hold it axially relative to the case 2C, to facilitate assembly, and to reduce the axial axial of the motor.

Once case portion 2C has been connected to case portion 2B by the screws 3A, the shaft 20B and the braking system can be put into place, preferably downwards, and thus without changing the assembly position of the motor.

The housings 76 and 78 constitute a first pair, In an advantageous variant, the motor has at least one second pair of housings comprising a first housing and a second housing respectively analogous to the housings 76 and 78, together with a second locking pin placed in the housings of the second pair.

The various pairs of housings are angularly offset from one another. Thus, in FIG. 2, dashed lines show the positions 76' and 78' of a second pair.

This disposition makes it possible to balance the tangential forces exerted on the locking pins. By way of example, it is possible to have two diametrically opposite pairs, or three pairs offset at 120° intervals, In addition, it is advantageous to provide two possible positions in which the distributor can be held angularly relative to the distribution cover.

To this end, for the, or each, pair of housings, the motor advantageously includes an additional housing, analogous to one of the first an second housings of the pair, and offset angularly from the housing with which it is analogous.

For example, the additional housing could be analogous to the housing 76 and likewise situated on an axial portion 70, and in the same transverse plane. Alternatively it could be analogous to the housing 78, being disposed on the axial part 72.

this disposition is particularly advantageous when the motor has a preferred operating direction. This is the case, for example, when the motor has two distinct operating cylinder capacities, i.e. when it comprises two "half-motors", in which, when operating at half capacity, all of the distribution ducts of the inactive half-motor are connected to the same main duct.

When that main duct is used for fluid exhaust, then the distribution ducts of the half-motor are at low pressure and the pistons of said half-motor provide no more than a small amount of resistance to rotation of the cylinder block as driven by the other half-motor. This is the preferred direction of rotation.

In contrast, when the main duct is used as a feed, then the distribution ducts of the inactive half-motor are at high pressure and its pistons provide greater resistance to rotation of the cylinder block, such that efficiency is lower than in the opposite direction.

A motor fo that type is described in document FR-A-2 678 322.

Depending on the application, it may be advantageous for the preferred direction of operation to be clockwise or counterclockwise. Without changing any of the fluid connections, the motor will operate in one direction or the other depending on whether the orifices of the distribution ducts in the distribution face occupy a first position relative to the lobes of the cam or a second position that is angularly offset relative to the first through an offset angle d defined as follows: $d=(2n+1)p$ where n is an integer and p represents the angular range occupied by one half-lobe of the cam.

Thus, if the angular offset between the additional housing and the other housing with which it is analogous satisfies the formula $d=(2n+1)p$, then the preferred operating direction is selected by placing the locking pin in said additional housing or in the housing with which it is analogous.

What is claimed is:

1. A hydraulic motor comprising:

a fixed case;

a reaction member secured to the case;

a cylinder block mounted to rotate relative to said reaction member about an axis of rotation and comprising a plurality of cylinder and piston assemblies disposed radially relative to the axis of rotation said cylinder being capable of being fed with fluid under pressure, through cylinder ducts which open in a communication face of the cylinder block which is perpendicular to the axis of rotation; and an internal fluid distributor secured to the case to prevent rotation about the axis of rotation and having a distribution face which is perpendicular to the axis of rotation and which is situated against the communication face of the cylinder block, and a first connection face, said distributor including distribution ducts which extend between the first connection face and the distribution face;

the case having a distribution cover portion situated around the distributor and presenting a second connection face situated facing the first connection face and having feed and exhaust ducts opening out therein, the distribution ducts of the distributor thus putting the cylinder ducts into communication with the main fluid feed and exhaust ducts;

wherein the distribution cover and the distributor are provided respectively with first and second axial parts in which there are formed at least a first substantially radial housing and at least a second substantially radial housing defining at least a first pair of housing situated facing each other, wherein the first housing has a first wall element situated on the side of said housing that is axially adjacent to the cylinder block while the second housing has a second wall element situated on the side of said second housing that is axially remote form the cylinder bloc, wherein the motor includes a locking pin for preventing rotation disposed in said first and second housings so as to extend substantially radially, wherein one of the first and second housings has axial dimensions measured along the axis of rotation of the motor that are greater than the corresponding dimensions of the pin to enable the distributor to move relative to the distribution cover, and wherein one of the first and second housings is a substantially radial through passage via which the pin is put into place.

2. A motor according to claim 1, wherein the first and second axial parts are formed respectively in an internal axial extension of the distribution cover which has the first housing passing therethrough and in an axial part of the distributor having an axially outer periphery in which the second housing forms a recess, and wherein the motor includes means for enabling the locking pin to be inserted in said first and second housings form the radially outer side of said internal axial extension.

3. A motor according to claim 2, wherein the internal axial extension of the distribution cover projects axially with respect to a substantially radial face of said distribution cover, a clearance zone being thereby provided on the radially outer side of said internal axial extension.

4. A motor according to claim 2, wherein the internal projection of the distribution cover extends inside a casing element that is distinct from the cover and that is assembled thereto.

5. A motor according to claim 1, wherein the first housing is constituted by a hold of dimensions adapted to receive the locking pin substantially without play.

6. A motor according to claim 5, wherein the second housing is constituted by a notch formed from an axial end of the distributor.

7. A motor according to claim 1, wherein the first and second axial parts are formed respectively in zones of the distribution cover and of the distributor that are adjacent to the cylinder block.

8. A motor according to claim 1, including at least one second pair of housings and a second locking pin for preventing rotation, said second pair comprising first and second housings respectively analogous to the first and second housings of the first pair, the second locking pin being disposed in the housings of the second pair of housings, and wherein the various pairs of housings are offset angularly relative to one another.

9. A motor according to claim 1, which, for each pair of housings, includes an additional housing analogous to one of the first and second housings of the pair and offset angularly relative to the housing with which it is analogous.

* * * * *